United States Patent [19]

Ketterer et al.

[11] 4,074,643

[45] Feb. 21, 1978

[54] RAIL-BEARING FOR ROTARY SHUTTLES

[75] Inventors: Stanley Joseph Ketterer, Jamesburg; William Weisz, Rockaway, both of N.J.

[73] Assignee: The Singer Company, New York, N.Y.

[21] Appl. No.: 697,886

[22] Filed: June 21, 1976

[51] Int. Cl.[2] ..... D05B 57/14

[52] U.S. Cl. ..... 112/181; 112/228

[58] Field of Search ..... 112/228, 232, 181–189

[56] References Cited

U.S. PATENT DOCUMENTS

| | | | |
|---|---|---|---|
| 3,447,499 | 6/1969 | Nakajima et al. | 112/228 |
| 3,536,022 | 10/1970 | Hanyu et al. | 112/181 |
| 3,698,333 | 10/1972 | Ketterer | 112/189 |

*Primary Examiner*—Werner H. Schroeder
*Assistant Examiner*—Moshe I. Cohen
*Attorney, Agent, or Firm*—Robert E. Smith; Edward L. Bell

[57] ABSTRACT

A rail-bearing for the shuttle in a shuttle type sewing machine in which the shuttle housing is provided with a circular rail formed to mate with a circular groove in the shuttle. This rail-groove combination is so arranged as to deter jamming of the shuttle by thread or errant bits of debris. This rail-bearing has inherent high speed capabilities and is easy to lubricate and to manufacture.

3 Claims, 5 Drawing Figures

RAIL-BEARING FOR ROTARY SHUTTLES

BACKGROUND OF THE INVENTION

All sewing machine shuttles require some type of bearing between the shuttle body and their supporting means. The most common types are those wherein the bearing surfaces are the outer edges of the shuttle and associated surfaces in the shuttle support housing. As such, very tight dimensional control must be maintained so that vibration during operation of the sewing machine may be kept to a minimum. This necessarily closed area is an ideal place for thread or foreign matter to collect and eventually jam the mechanism. Also, due to the shape of the bearing surfaces and their accessibility, uniform lubrication is very difficult.

SUMMARY OF THE INVENTION

An object of this invention is to provide a bearing system for a sewing machine shuttle which is virtually jam proof, is easily lubricated, and offers vibration free high speed operation. These objectives are achieved by utilizing a novel rail and groove as the bearing surfaces along the path of travel of the shuttle. As such, the need for tight surrounding walls around and under the shuttle is obviated thereby opening up the areas where thread and foreign matter may collect, thus virtually eliminating the possibility for jamming.

With the above and additional objects and advantages in view as will hereinafter appear, this invention will be described in reference to the accompanying drawing of the prefered embodiment.

DESCRIPTION OF THE PREFERRED EMBODIMENT

Figure 2:
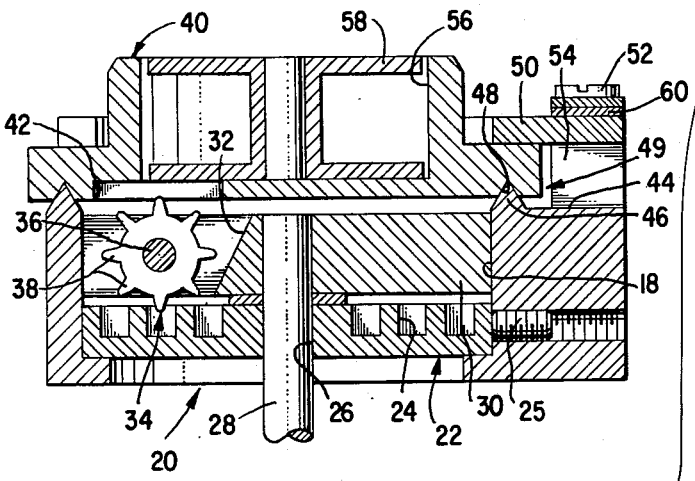
FIG. 2 is a cross-sectional view of the invention taken substantially along the line 2—2 in FIG. 1.
Figure 3:
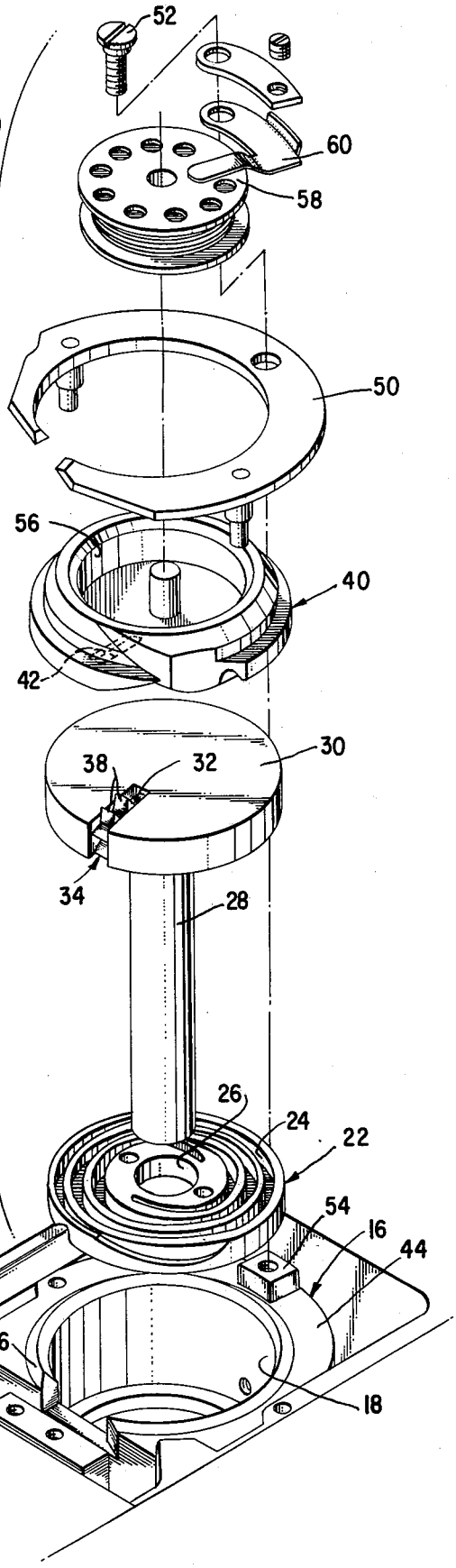
FIG. 3 is an exploded perspective view of the shuttle and the shuttle drive mechanism.
Figure 1:
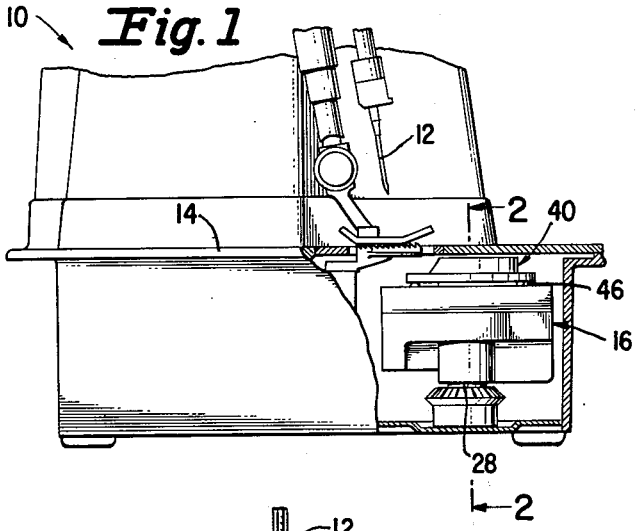
FIG. 1 is a side elevational view of a sewing machine in which the invention is incorporated.
Figure 4:
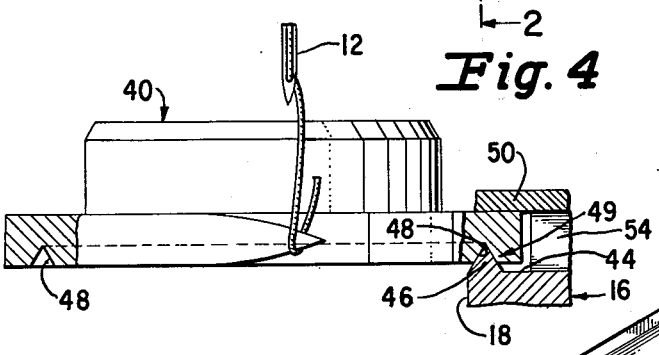
FIG. 4 is a functional view showing the needle thread being caught by the shuttle.

Referring to the drawing of a preferred embodiment, a sewing machine is generally referred to by the reference number 10. The sewing machine 10 has an endwise reciprocating needle 12 for the formation of stitches and a work supporting bed 14. Within the work supporting bed 14 is a stationary support means 16 having a central bore 18 for containing a vertical axis shuttle drive mechanism 20.

The shuttle drive mechanism 20 is substantially the same as that disclosed in U.S. Pat. No. 3,698,333, and consists of a plate 22 having a helix 24 formed in one surface thereof and a central hole 26 formed therethrough coaxial with the helix 24. The plate 22 is held in position by set screw 25 such that the central axis of the helix 24 is coaxial with the central axis of the bore 18. Extending through the hole 26 is a shuttle drive shaft 28 to which is attached a shuttle driver 30. The shuttle driver 30 is formed having a radial slot 32 in which a pinion 34 is constrained. The pinion 34 is journaled in the shuttle driver 30 on an axle pin 36 secured therein so that the pinion 34 may turn on its own axis within the slot 32. As shown in FIG. 2 the pinion 34 is carried in the shuttle driver 30 such that the pinion teeth 38 protrude axially from both sides of the shuttle driver 30 for both meshing with the helix 24 and urging motion to a shuttle 40. Correspondingly, the shuttle 40 is formed with a radial slot 42 for embracing the pinion 34.

The stationary support means 16 has an upper surface 44 on which is formed a circular rail 46 located at and extending substantially around the perimeter of the bore 18. The shuttle 40 is formed with a circular groove 48 for engaging the rail 46. The rail 46 and the groove 48, which together form a rail-bearing 49, are sized such that the shuttle 40 will not contact any other portion of the stationary support means 16. The shuttle 40 is held in constant contact with the rail 46 by means of a resilient retainer 50 which is secured by a screw 52 to a boss 54 formed in the upper surface 44 of the stationary support means 16. The shuttle 40 is also formed with a cavity 56 which contains a thread bobbin 58 held in position by a retainer 60 also secured by the screw 52.

Due to the engagement of the rail 46 in the groove 48 brought about by the retainer 50, shuttle 40 is restrained from any axial movement. Thus there is no need for tight peripheral walls, and, as in the present structure, these restraining walls may be eliminated completely. Also, since the shuttle 40 is supported entirely by the rail-bearing 49, and does not contact any other portion of the stationary support means 16, there exists a finite space between the shuttle 40 and the surface 44. These spaces, around the periphery and underneath the shuttle 40, allow thread and other foreign matter to pass without impeding the movement of the shuttle 40 thus virtually eliminating the possibility for jamming.

The rail-bearing 49 is a solid-type bearing in constant contact with the shuttle 40. This factor in conjunction with the positive drive characteristics of the drive mechanism 20 keeps vibration down to a minimum, enhancing high speed performance. When the shuttle 40 is removed, the associated parts of the rail-bearing 49 are completely exposed enabling them to be easily lubricated without contaminating neighboring areas that may need to be free from lubricants.

Figure 5:
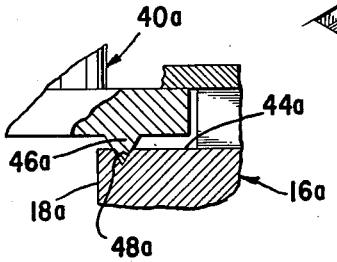
FIG. 5 is a partial sectional view of the bearing support for a shuttle mechanism illustrating another embodiment of the invention.

FIG. 5 shows a modification of the invention wherein a rail **46*a* is formed in the bottom of a shuttle 40*a* and a groove 48*a* is formed in an upper surface 44*a* of a stationary support means 16*a* around the periphery of a central bore 18*a***.

Having thus set forth the nature of the invention, what we heretofore claim is:

1. In a sewing machine having a thread carrying needle, a rotary shuttle, said shuttle being adapted for catching successive loops of needle thread in the formation of stitches, a drive mechanism for imparting movement to said shuttle, and stationary support means having a plane surface over which said shuttle moves, bearing means comprising cooperating and engaging structures formed circularly on the plane surface of said support means over which said shuttle moves and on the surface of said shuttle adjacent to said support means plane surface at least one of said bearing means projecting from the surface on which it is formed sufficiently to maintain a spaced relationship between the body of said shuttle and the plane surface of said support means and to singularly restrain radial movement of said shuttle relative to the axis of rotary movement thereof, and means for maintaining the engagement of said cooperating structures.

2. Bearing means as set forth in claim 1 wherein said cooperating structures comprise said shuttle being formed with a circular groove therein and said support means having a circular rail formed on the plane surface thereof, said rail having such a height as to prevent the body of said shuttle from contacting said support means.

3. Bearing means as set forth in claim 1 wherein said cooperating structures comprise said shuttle having a circular rail formed thereon and the plane surface of said support means being formed with a circular groove therein.

* * * * *